US010947752B2

(12) United States Patent
Waclawiak et al.

(10) Patent No.: US 10,947,752 B2
(45) Date of Patent: Mar. 16, 2021

(54) UTILITY POLE CADDY

(71) Applicant: Avangrid, Inc., Orange, CT (US)

(72) Inventors: Mark Waclawiak, Branford, CT (US); Andrew J. Kasznay, III, Middletown, CT (US)

(73) Assignee: Avangrid, Inc., Orange, CT (US)

( * ) Notice: Subject to any disclaimer, the term of this patent is extended or adjusted under 35 U.S.C. 154(b) by 13 days.

(21) Appl. No.: 16/503,005

(22) Filed: Jul. 3, 2019

(65) Prior Publication Data

US 2020/0232241 A1 Jul. 23, 2020

Related U.S. Application Data

(60) Provisional application No. 62/793,658, filed on Jan. 17, 2019.

(51) Int. Cl.
*F16M 13/00* (2006.01)
*E04H 12/22* (2006.01)

(52) U.S. Cl.
CPC ..... *E04H 12/2238* (2013.01)

(58) Field of Classification Search
None
See application file for complete search history.

(56) References Cited

U.S. PATENT DOCUMENTS 3,236,398 A * 2/1966 Thiermann ..... E04H 12/34 414/23
3,391,730 A * 7/1968 Calhoun, Jr. ..... F25D 3/00 165/47
4,442,991 A * 4/1984 Levens ..... B65G 1/14 108/55.3
4,832,398 A * 5/1989 Tecca ..... B63C 11/22 294/151
4,847,974 A 7/1989 Pelfrey
5,346,165 A * 9/1994 Frean ..... F17C 13/084 248/146
8,631,627 B2 1/2014 Atchley
(Continued)

FOREIGN PATENT DOCUMENTS

CN 2646081 Y 10/2004
CN 203006067 U 6/2013
(Continued)

OTHER PUBLICATIONS

Oficina Espanola De Patents Y Marcas; ES 201931069; Search Report; dated May 8, 2020.
(Continued)

*Primary Examiner* — Amy J. Sterling
(74) *Attorney, Agent, or Firm* — Wiggin and Dana LLP; Gregory S. Rosenblatt

(57) ABSTRACT

A utility pole caddy has a trapezoidal-shaped component with a base and an opposing top. The top includes a concave portion effective to receive a utility pole positioned horizontally relative to the ground. The dimensions of the utility pole caddy are effective to deny pole movement without mechanical assistance. This utility pole secures utility poles at temporary work sites and prevents rolling, reduces vandalism by requiring a machine to remove a pole from the device, and assists crews setting poles by elevating the tops of the poles prior to setting.

5 Claims, 4 Drawing Sheets

(56) References Cited

U.S. PATENT DOCUMENTS

| | | | | |
|---|---|---|---|---|
| 9,739,070 | B2 | 8/2017 | Bushore | |
| 9,777,500 | B1 | 10/2017 | Reisdorff | |
| 2003/0205656 | A1* | 11/2003 | Updegrove | F42B 22/06 248/505 |
| 2006/0091279 | A1* | 5/2006 | Jones | F16L 3/02 248/431 |
| 2010/0148018 | A1 | 6/2010 | Schoenau et al. | |
| 2011/0290952 | A1* | 12/2011 | Masters | F16L 3/223 248/68.1 |
| 2014/0197283 | A1 | 7/2014 | Lake | |

FOREIGN PATENT DOCUMENTS

| | | | |
|---|---|---|---|
| EP | 3309090 | A1 | 4/2018 |
| JP | S514337 | Y1 | 1/1976 |
| JP | 52-113965 | U | 8/1977 |
| JP | H0617971 | A | 1/1994 |
| JP | 2001234581 | A | 8/2001 |
| JP | 2004084431 | A | 3/2004 |
| JP | 2006038203 | A | 2/2006 |
| JP | 2008185042 | A | 8/2008 |

OTHER PUBLICATIONS

United Kingdom Intellectual Property Office; GB1915834.4; Search Report under Section 17; dated Apr. 2020.

* cited by examiner

UTILITY POLE CADDY

CROSS-REFERENCE TO RELATED PATENT APPLICATION

This patent application claims a benefit to the Jan. 17, 2019 filing of U.S. Provisional Patent Application Ser. No. 62/793,658, that is titled "Utility Pole Caddy." The disclosure of U.S. 62/793,658 is incorporated by reference herein in its entirely.

BACKGROUND OF THE DISCLOSURE

1. Field of the Disclosure

The present disclosure relates generally to the utility industry and more specifically to a device and method for the delivery and setting of utility poles. This device secures poles at temporary work sites to prevent rolling, reduces vandalism by requiring a machine to remove a pole from the device, and assists crews setting poles by elevating the tops of the poles prior to setting.

2. Description of the Prior Art

Utility poles left at construction sites unsecured by mechanical methods can roll under various conditions. Grade, distance from changing grades and ground type all contribute to the risk of poles rolling. Poles left on-site can often be accessed by the public and, without mechanical methods securing the poles in place, the public can suffer injury if the poles begin to roll.

One previous method of pole securement included driving a stake into the ground beside the pole when a determination was made that there was risk of the pole rolling. Wooden stakes can be easily defeated by the public, and if located in an area where the risk of a pole rolling has been determined, the public can suffer injury if the pole begins to roll.

Poles that are left on-site must be elevated and propped up before a strap utilized for setting the pole can be secured around the pole. This action increases the risk of injury to the pole setting crew.

There are patents for bracing utility poles while they are in their final upright position. Exemplary are U.S. Pat. No. 9,739,070, "Methods and Apparatuses of Supporting and Bracing a Utility Pole," to Bushore; U.S. Pat. No. 8,631,627, "Helical Pole Support Bracket and Method for Supporting a Pole," to Atchley; and U.S. Pat. No. 9,777,500, "Pole Reinforcement," to Reisdorff. None of these patents address securing poles prior to setting the pole.

SUMMARY OF THE DISCLOSURE

A primary object of the invention is to provide a device that will secure a pole left at a work site without being able to be defeated by the general public without machine intervention.

Another object of the device is to allow for the pole to be pre-elevated for the pole setting crew to eliminate the raising and propping step of pole setting.

Another object of the device is to allow for a method of securement that will not be easily defeated in icy conditions.

BRIEF DESCRIPTION OF THE DRAWINGS

Other features and advantages of the present invention will be better understood when discussed in conjunction with the illustration.

The invention is embodied in the form illustrated in the accompanying drawings, however the drawings are illustrative only and changes may be made in the specific construction.

DETAILED DESCRIPTION

Figure 1:
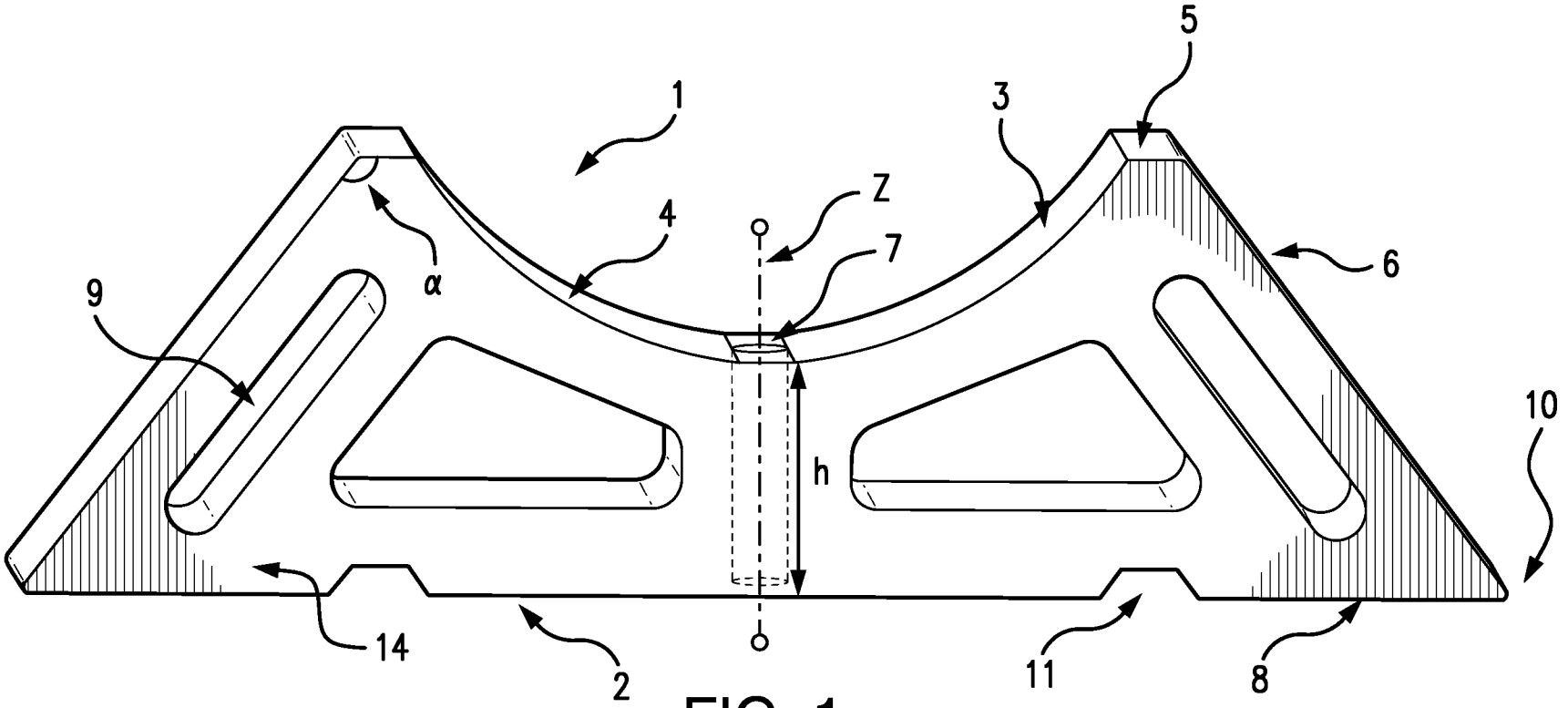
FIG. 1 is a side view of a utility pole caddy.
Figure 2:
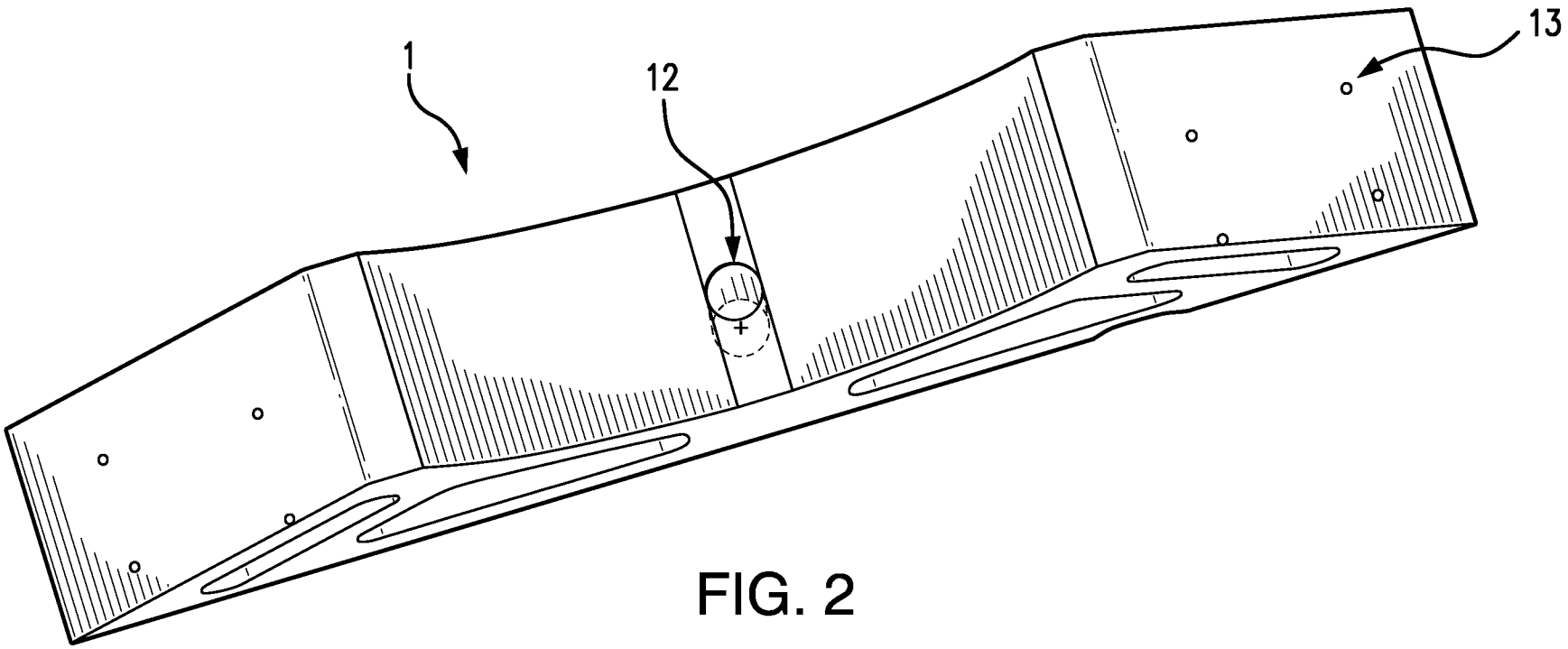
FIG. 2 is a top view of the pole caddy of FIG. 1.

With reference to FIGS. 1 and 2, the utility pole caddy 1 is a trapezoidal-shaped high-grade plastic cradle having symmetry around a central axis "z" extending from a base 2 to a top surface 3 ("base" and "top" define surfaces when the utility pole caddy is positioned for intended use. The top surface 3 includes a concave parabolic portion 4 for two points of contact on a utility pole that is set horizontally relative to the ground along the concave parabolic portion. Two ends of the concave parabolic portion 4 round into a flat plane 5 that culminates in sides 6 that connect the base to the top. The length of the sides 6 and angle, a, between the flat plane 5 and the sides 6 provide a sufficient height, h, as measured from the nadir 7 of the concave parabolic portion 4 to a ground contacting surface 8 of the base 2 such that when a pole top is set, the pole is propped up from the ground and the crew can work a strap beneath the pole.

The interior of the utility pole caddy has a cut-out 9 to attach a handle or strap for easy handling. In one embodiment, the cut-out 9 has an oval shape. Additional cut-outs may be included to remove unnecessary material and weight.

Base corners 10 are rounded for worker safety. Optionally, the base includes notches 11 to facilitate stacking a utility pole caddy 1 on top of another iteration of itself. As another optional feature, a center hole 12 extends through a mid-portion for stacking multiple pole caddies 1 on a rod on the crew's truck. Typically, the rod will be a corrosion and rust-resistant metal. Optionally, center hole 12 can support a stake driven into the ground for additional roll protection and to thwart efforts to dislodge the utility pole caddy.

Multiple, such as eight, threaded circular cutouts 13 are located at the base for the installation of screws to cut into the ground and prevent slippage, including in icy conditions. Alternatively, rather than screws, protrusions 14 formed in the base 2 extend from the ground contacting surface 8 to limit movement on hard or frozen surfaces.

One preferred plastic to manufacture the utility pole caddy 1 is ultra-high molecular weight polyethylene. Exemplary dimensions for a utility pole caddy (length/width/height) are 26×4×8 inches for supporting small diameter utility poles up to Class H1 distribution poles. The dimensions can vary based on the pole size ranges required. The utility pole caddy is designed to withstand a compressive force of about 6,000 pounds without deformation.

Figure 3:
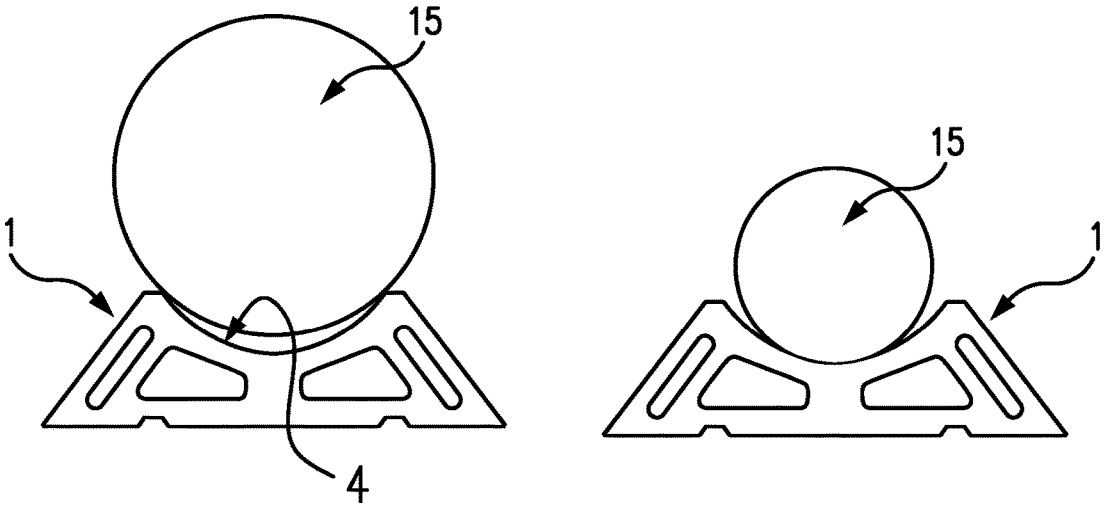
FIG. 3 is an end view of the pole caddy of FIG. 1 illustrating different pole sizes being accommodated.

FIG. 3 illustrates how the parabolic interior shape allows for securement of different diameters of utility poles, from small diameter utility poles up to Class H1 distribution poles. The utility pole caddy can be scaled to handle larger poles including transmission poles, as high tensile strength plastic can be used to ensure proper per square inch support.

Figure 4:
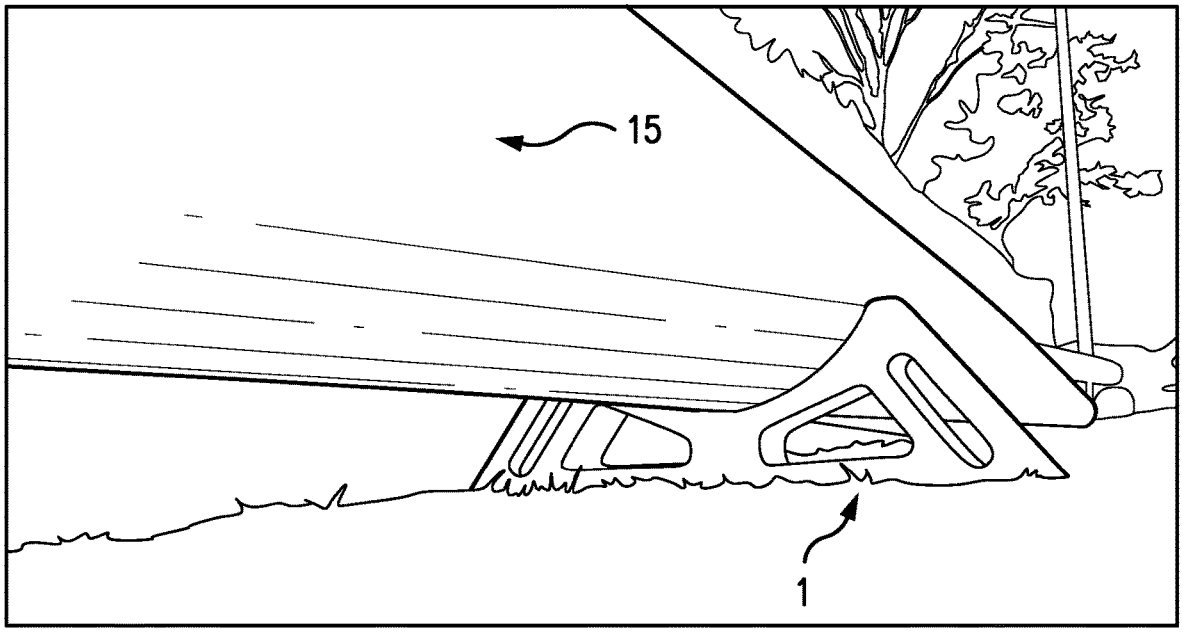
FIG. 4 is a side view of the utility pole caddy of FIG. 3 accommodating a utility pole.

FIG. 4 is a side view of the utility pole caddy of FIG. 3 accommodating a utility pole illustrating how a portion of the utility pole is elevated to facilitate the slipping of a strap beneath the pole prior to setting.

Figure 5:
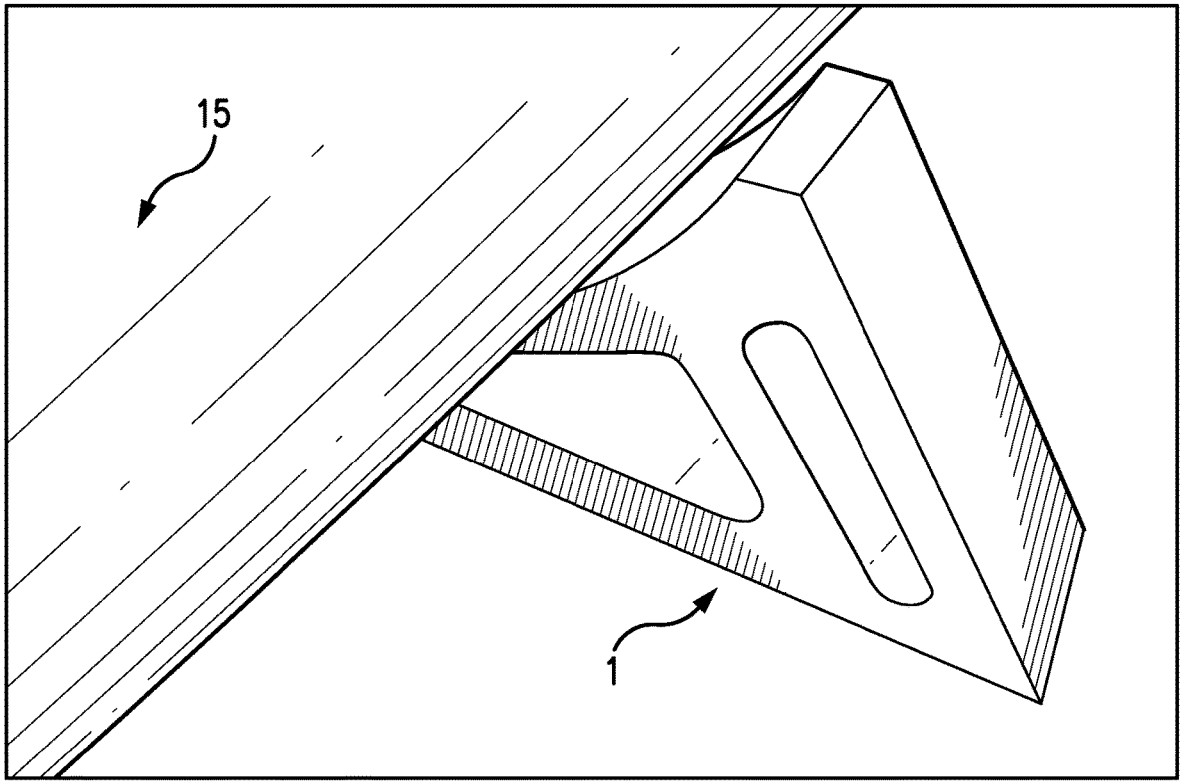
FIG. 5 is a close-up side view of the utility pole caddy accommodating a utility pole of FIG. 4.

FIG. 5 is a close-up side view of the utility pole caddy accommodating a utility pole of FIG. 4.

A typical utility pole has a diameter of between 10 and 18 inches and a weight of between 700 and 4000 pounds. Typically there is one utility pole caddy used per pole and the typical weight supported by this utility pole caddy is about 1,000 lbs.

We claim:

1. A utility pole caddy, comprising:

a trapezoidal-shaped component having a base and an opposing top;

the top including a concave parabolic portion that receives a utility pole positioned horizontally relative to the ground by two points of contact;

wherein dimensions of the utility pole caddy are effective to deny pole movement without mechanical assistance.

2. The utility pole caddy of claim 1 wherein the concave portion is a parabola sized to accommodate a range of utility pole diameters with two points of contact.

3. The utility pole caddy of claim 1 wherein a nadir of the concave portion is spaced from the base providing an opening to receive a setting strap.

4. The utility pole caddy of claim 1 further including protrusions extending from the base effective to limit movement on hard or frozen surfaces.

5. The utility pole caddy of claim 1 formed from a material capable of withstanding a compressive force of 6,000 pounds without deformation.

* * * * *